US008460395B2

(12) United States Patent
Smulowitz

(10) Patent No.: US 8,460,395 B2
(45) Date of Patent: Jun. 11, 2013

(54) ENVIRONMENTALLY SENSITIVE MULTI-USE APPARATUS FOR ADMINISTERING AND DISPENSING LAUNDRY ADDITIVES

(75) Inventor: Marc S. Smulowitz, Shawanes, PA (US)

(73) Assignee: Marc S. Smulowitz, Shawanese, PA (US)

( * ) Notice: Subject to any disclaimer, the term of this patent is extended or adjusted under 35 U.S.C. 154(b) by 344 days.

(21) Appl. No.: 12/804,886

(22) Filed: Aug. 2, 2010

(65) Prior Publication Data

US 2012/0023678 A1 Feb. 2, 2012

(51) Int. Cl.

| | |
|---|---|
| ***C11D 17/00*** | (2006.01) |
| ***C11D 3/60*** | (2006.01) |
| ***C11D 3/39*** | (2006.01) |
| ***C11D 3/12*** | (2006.01) |
| ***C11D 17/04*** | (2006.01) |

(52) U.S. Cl.
USPC ..... 8/137; 510/276; 510/277; 510/294; 510/297; 510/298; 510/438; 510/445; 510/310; 510/367

(58) Field of Classification Search
USPC ..... 510/276, 294, 297, 298, 438, 445, 510/310, 367; 8/137
See application file for complete search history.

(56) References Cited

U.S. PATENT DOCUMENTS

| | | | | |
|---|---|---|---|---|
| 4,014,105 | A * | 3/1977 | Furgal et al. | 34/389 |
| 5,244,593 | A * | 9/1993 | Roselle et al. | 510/127 |
| 5,768,917 | A * | 6/1998 | Freida | 68/17 R |
| 2005/0008861 | A1 * | 1/2005 | Yadav et al. | 428/403 |
| 2007/0149424 | A1 * | 6/2007 | Warr et al. | 510/101 |

FOREIGN PATENT DOCUMENTS

| | | | |
|---|---|---|---|
| TW | 259003 | * | 3/2005 |

* cited by examiner

*Primary Examiner* — Lorna M Douyon
*Assistant Examiner* — Amina Khan

(57) ABSTRACT

Devices for delivering reusable environmentally friendly laundry additives to a plurality of wash cycles and drying cycles are provided. The devices include a container that has an inner chamber and a plurality of apertures and protrusions located on an exterior surface thereof. The apertures are configured to allow the laundry additive to leave the inner chamber and interact with clothing during a plurality of wash cycles and drying cycles. The protrusions are configured to make contact with, and soften, clothing during the drying cycles. The container is configured to receive the laundry additive by a user of the device, prior to placing the device in a first wash or drying cycle, and effectively disperse and administer said additives.

16 Claims, 5 Drawing Sheets

ENVIRONMENTALLY SENSITIVE MULTI-USE APPARATUS FOR ADMINISTERING AND DISPENSING LAUNDRY ADDITIVES

FIELD OF THE INVENTION

The field of the present invention relates to methods and devices for cleaning and softening cloths and, more particularly, to methods and devices for cleaning and softening cloths more efficiently and economically using a standard washing machine and cloths dryer. The methods and devices of the present invention employ the use of materials that are environmentally sensitive, less harmful to the environment and safer for people suffering from chemical sensitivities, relative to currently-available laundry chemicals and fabric softeners. The purpose of the present invention is to create an apparatus that reduces the amount of toxic chemicals that are pervasively released into the fresh water supply after washing, and provide a safer alternative for people suffering from respiratory and dermatological issues stemming from chemical sensitivities.

BACKGROUND OF THE INVENTION

Over the years, many different types of laundry chemicals, additives, and fabric softeners have been developed and commercialized. Many of these compositions are administered to a wash cycle, or a drying cycle, but not both. In addition, many of the currently-available detergents, additives, and fabric softeners are fully utilized during a single wash or drying cycle, thereby requiring that such laundry additives be replenished for each subsequent wash cycle or drying cycle. Many of these traditional additives have shown that they may cause significant and pervasive health and environmental issues.

In view of the foregoing, there is a need for improved laundry additives and methods of use thereof, which may be added to both a wash cycle and a drying cycle that are reusable, effective, convenient and safe for people's health and the environment. In addition, it is preferable that such additives be usable in a plurality of wash cycles. Still further, the improved laundry additives and methods of use thereof will preferably employ the use of compositions and materials that are environmentally safe, and beneficial for people who suffer from chemical related sensitivities. As described further below, the present invention addresses these demands, and provides other benefits and improvements over currently-available detergents, additives, and fabric softeners. Some of these benefits include better environmental sensitivity, convenience, time savings, potential health benefits, and potentially significant cost savings.

SUMMARY OF THE INVENTION

According to certain aspects of the invention, devices for delivering a proprietary laundry additive to a plurality of wash cycles and drying cycles are provided. The devices include a container that has an inner chamber and a plurality of apertures and protrusions located on an exterior surface thereof. The apertures are configured to allow the laundry additive to leave the inner chamber and interact with clothing during a plurality of wash cycles and drying cycles. The devices are configured to be added to a wash cycle, and then carried over to a drying cycle for the same batch of cloths.

The protrusions located on the exterior surface of the container are configured to make contact with, and soften, clothing during the drying cycles by gently "massaging" the fibers.

Additionally, the protrusions are designed to gently separate the cloths during the drying cycles for increased air circulation, which results in faster drying times and energy savings. These actions may also reduce wrinkles and lint in the dryer and reduce ironing outside to the dryer. The container will further include a removable cap, which allows a user to add a laundry additive to the inner chamber of the container prior to a wash or drying cycle. As mentioned above, the invention provides that the devices will comprise (and will be effective to deliver to a plurality of wash and drying cycles) at least one laundry additive, which will preferably comprise the detergent boosters and/or other compositions described herein. The proprietary additives are environmentally friendly, and can be reused multiple times, potentially creating significant cost savings over traditional additives that are used only once.

According to additional aspects of the invention, methods of using the devices for delivering a laundry additive are provided. More particularly, such methods generally comprise (a) inserting one or more laundry additives into the inner chamber of the laundry additive delivery device; (b) placing the laundry additive delivery device described herein (and a set of cloths) in a wash cycle; and (c) following the wash cycle, transferring the cloths and the laundry additive delivery device to a drying cycle.

The above-mentioned and additional features of the present invention are further illustrated in the Detailed Description contained herein.

DETAILED DESCRIPTION OF THE INVENTION

Figure 1:
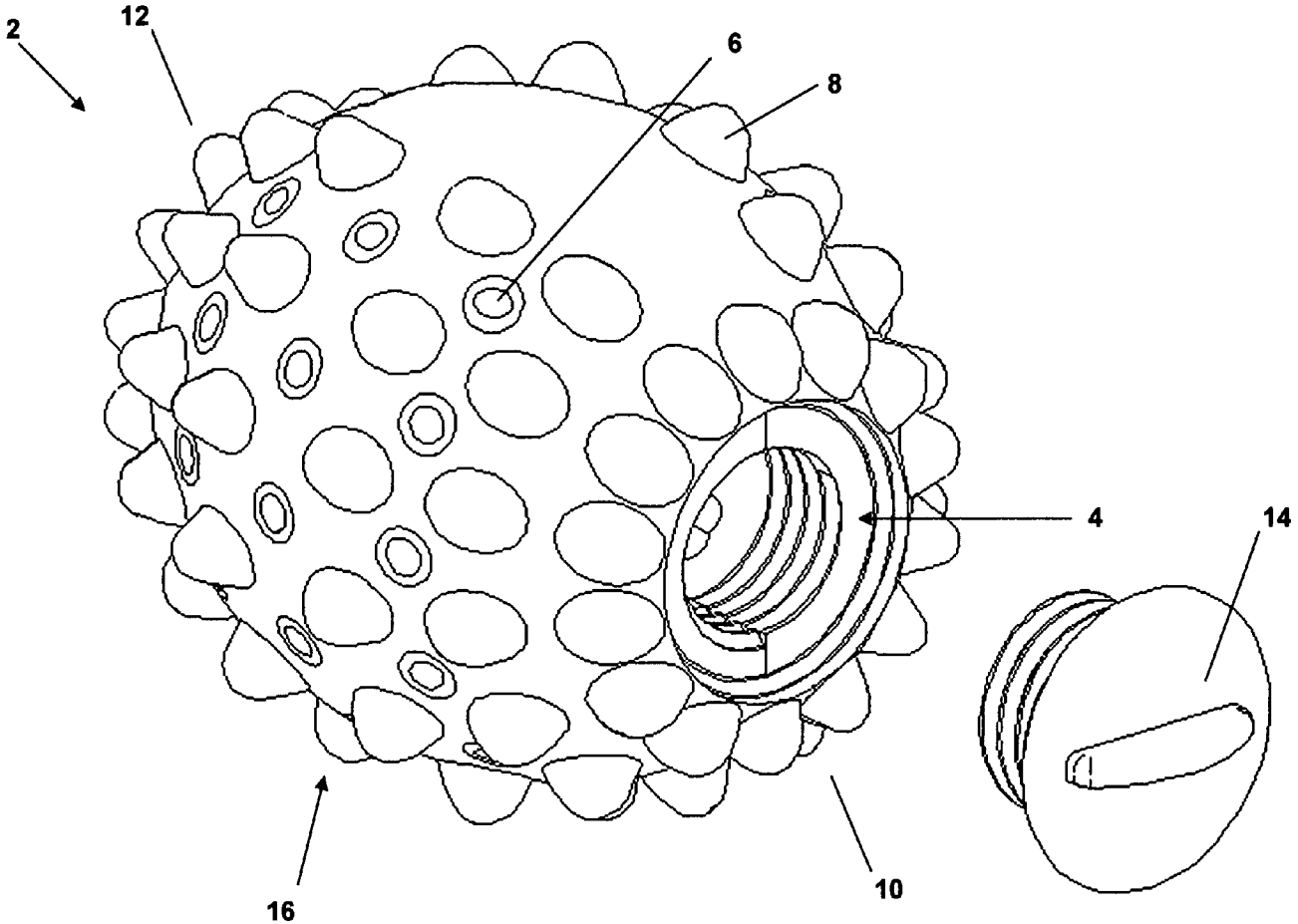
FIG. 1 is an exterior perspective view of the additive delivery device described herein, showing the cap portion thereof removed from the device.
Figure 2:
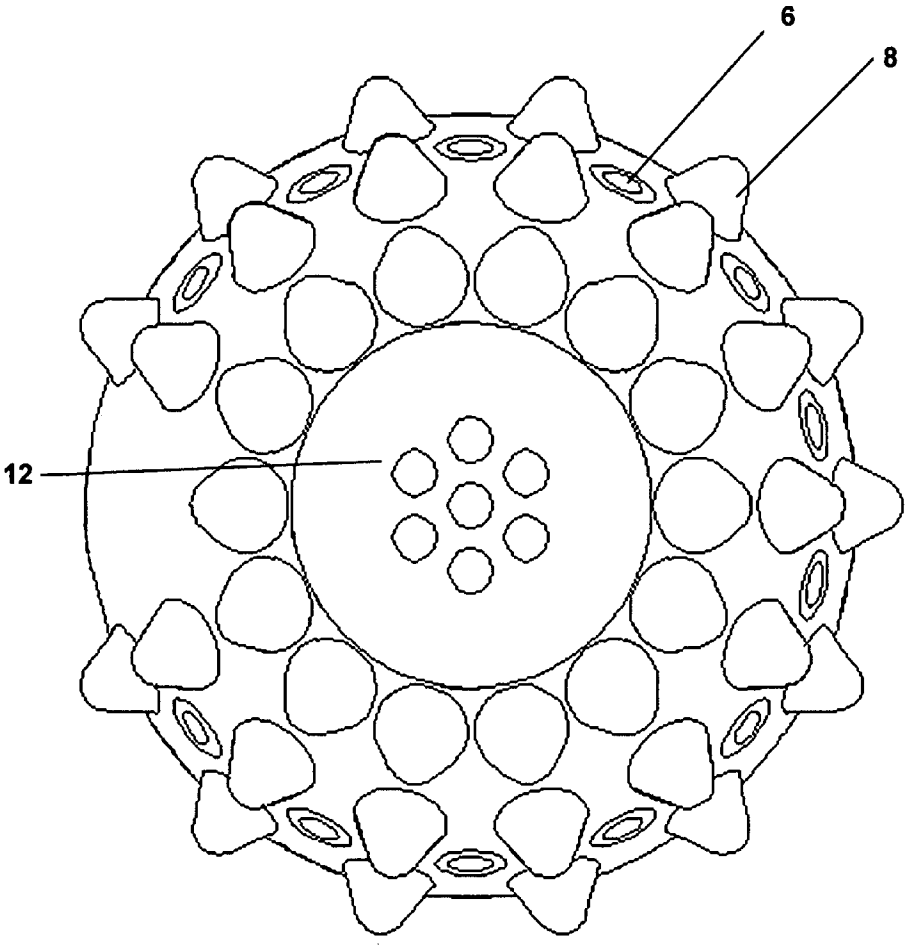
FIG. 2 is a backside view of the additive delivery device described herein.
Figure 3:
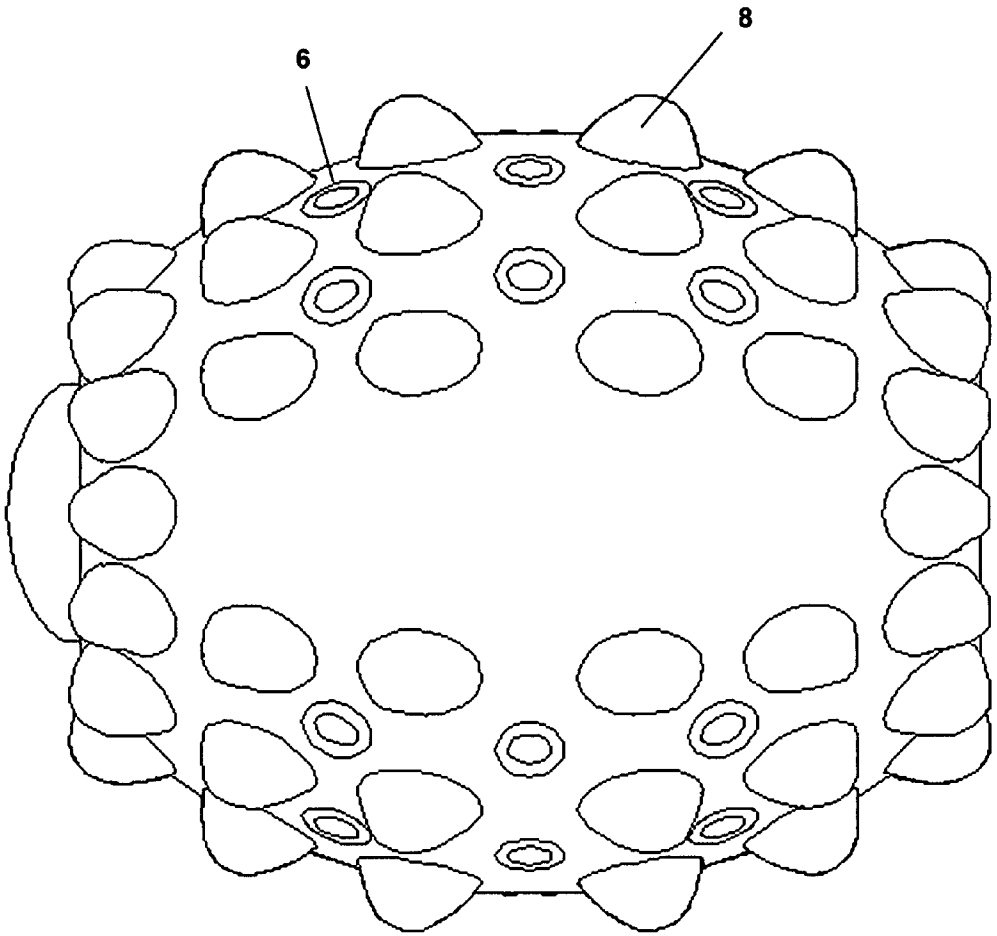
FIG. 3 is a side view of the additive delivery device described herein.
Figure 4:
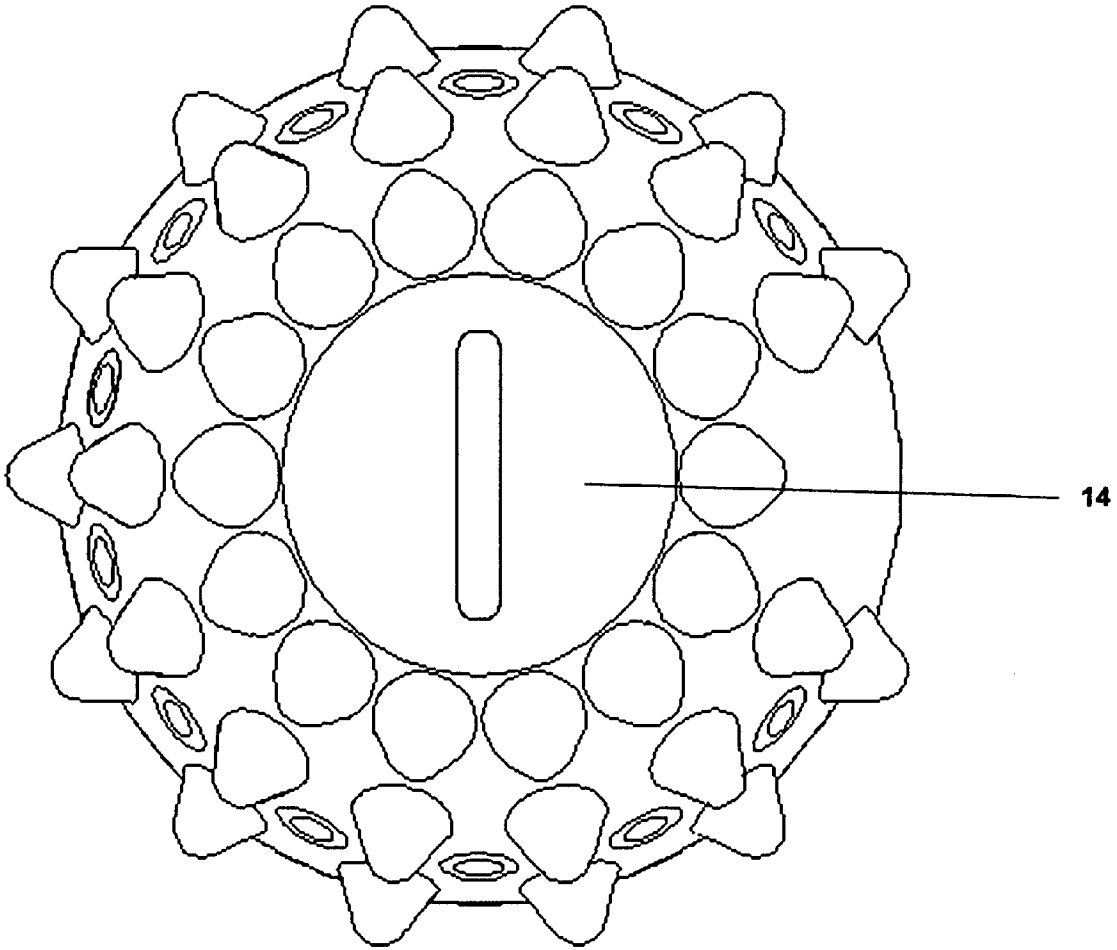
FIG. 4 is a front side view of the additive delivery device described herein.
Figure 5:
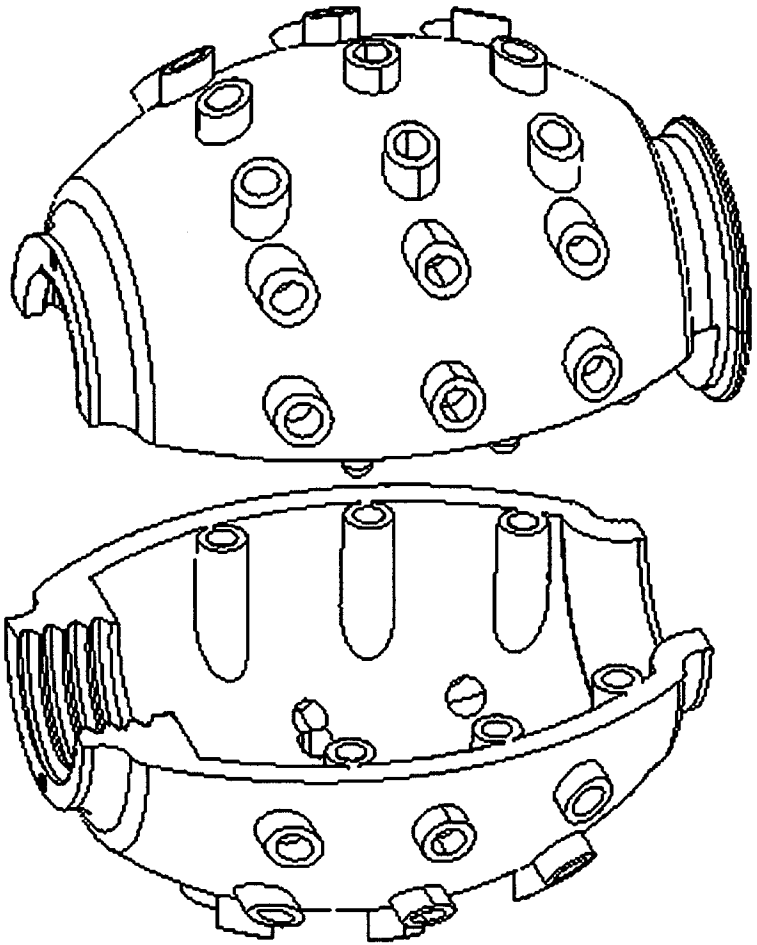
FIG. 5 is a disassembled view of the additive delivery device described herein.
Figure 5:
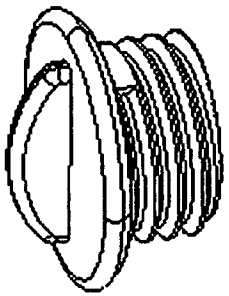

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used, and made without departing from the scope and spirit of the invention.

According to certain preferred embodiments of the present invention, and referring to FIGS. 1-5, devices and methods for delivering a laundry additive to a plurality of wash cycles and drying cycles are provided. The devices generally comprise a container 2 that includes an inner chamber 4, with a plurality of apertures 6 and protrusions 8 located on an exterior surface of the container 2. The invention provides that the apertures 6 are preferably circular in dimension, and will be configured to allow the laundry additive to leave the inner chamber 4 over a period of time, and interact with clothing during at least one wash cycle (or a plurality of wash cycles) and at least one drying cycle (or a plurality of drying cycles). The invention provides that the protrusions 8 preferably exhibit a rounded, convex shape—and are configured to make contact with clothing during a drying cycle, such as by frictionally rubbing the cloths during a drying cycle, which will serve to soften, massage, and detangle such clothing. The protrusions 8 will also be effective to create air passages within a bundle of clothing that will facilitate a more efficient and thorough drying of the cloths.

The invention provides that, in certain preferred embodiments, the container 2 comprises a cap 14 that may be reversibly removed from and attached to an opening at a first end 10 of the container 2, such that a user may dispose the laundry additive described herein into the interior chamber 4 of the container 2, and then secure the cap 14 to the container 2. The invention provides that the cap 14 may be reversibly secured to the container 2 vis-à-vis corresponding threads (i.e., a cap 14 that may be screwed onto the container 2), a mechanical snap connection, a magnetic attraction between the cap 14 and the first end 10 of the container 2, or other suitable means.

As mentioned above, the invention provides that the protrusions 8 located on the exterior surface of the container 2 will preferably exhibit a convex rounded configuration. This configuration will preferably be effective to cause the protrusions 8 to make contact with, soften, and detangle a plurality of clothing items during a drying cycle. According to certain preferred embodiments, the container 2 is comprised of thermoplastic elastomer (a.k.a. TPE), which is more environmentally-friendly (compared to other types of plastics). In certain alternative embodiments, however, the container 2 may be comprised of other types of plastics, such as polyvinyl chloride (PVC).

As illustrated in FIG. 1, the invention provides that the container 2 preferably exhibits an egg-shaped dimension, which has a circumference that is greatest in a center area 16 (and gradually becomes smaller from the center area 16 to each side of the container 10, 12). In certain embodiments, the circumference in the center area 16 will range between 5 inches and 11 inches or, preferably, between 7 inches and 9 inches or, more preferably, will be about 8 inches. The length of the container 2 (from side 10 to side 12) will preferably range between 7 inches and 13 inches or, more preferably, between 9 inches and 11 inches or, still more preferably, will be about 10 inches.

The number of apertures 6 located on the exterior surface of the container 2 will be sufficient to allow the laundry additive to slowly be released through the apertures 6 of the container 2, and into a washing cycle and, subsequent thereto, into a drying cycle. By way of illustration, for a device of the present invention that exhibits a circumference in the center area 16 of about 8 inches, and a circumference from side 10 to side 12 of about 10 inches (with the total length from side 10 to side 12 being about 3.5 inches), the container 2 will comprise approximately 60 apertures 6 (and approximately 80 protrusions 8). According to such example, the apertures 6 of the container 2 will preferably exhibit a circular dimension, having a diameter of approximately ¼ of an inch, whereas the approximate diameter of the protrusions 8 will be about 7/16 of an inch.

The invention provides that the laundry additive disposed in the container 2 will preferably comprise, but will not be limited to, a washing agent, a fragrance, a softening agent, a disinfecting agent, a whitening agent, or a combination thereof, and will preferably be configured as a solid (such as in the form of small spherical pearls). More preferably, however, the washing agent that is included in the laundry additive will comprise a washing booster, which may be used in combination with a conventional detergent. The invention provides that when the laundry additive is formulated as a detergent booster, the conventional detergent may be added to a wash cycle vis-à-vis the device described herein (and/or separate and apart from the device).

In certain preferred embodiments, the laundry additive will preferably comprise, but will not be limited to, sodium percarbonate, sodium bicarbonate, nano silver, tea tree oil, and/or coconut acid monoethanol (CMEA)—which will be useful for cleaning cloths during a wash cycle and serving as a detergent booster. Preferably, the foregoing components are formulated into a homogenous, solid pellet. The invention provides that the laundry additive will, preferably, further comprise a plurality of elongated elements (or cartridges) that are designed for a drying cycle, which will comprise recycled paperboard, soy wax, fragrance, an ecologically-friendly fabric softener (e.g., a plant-based or vegetable-based fabric softener), or combinations thereof. The invention provides that such elongated elements (or cartridges) will be useful for softening and imparting a desirable fragrance to cloths during a drying cycle.

In addition to the devices for delivering a laundry additive to a wash cycle and a drying cycle described herein, the invention further encompasses methods of using such devices. More particularly, for example, such methods generally comprise placing the laundry additive delivery device described herein (and a set of cloths) in a wash cycle. As described herein, the laundry additive delivery device will include (in the inner chamber portion thereof) the laundry additive described herein. In certain preferred embodiments, the laundry additive will be slowly released from the device in the wash cycle and will serve as a detergent booster, such that the laundry additive delivery device will be added to a wash cycle along with a conventional laundry detergent (or a laundry detergent alternative). In certain alternative embodiments, however, the laundry additive that is dispensed by the device of the present invention may comprise conventional laundry detergent as well.

During the wash cycle, the invention provides that the laundry additive will, over time, be gradually dispensed from the apertures located in the container of the device, such that the laundry additive is allowed to dissolve in the water and interact (and clean) the cloths. Following at least one wash cycle, the methods of the invention require that the cloths be transferred from the at least one wash cycle to a drying cycle, along with the laundry additive delivery device. As described above, the protrusions located on the exterior surface of the container will make continuous contact with, and will impart a frictional force to, the cloths during the drying cycle, which will be effective to soften and detangle the clothing items. In addition, the protrusions located on the exterior surface of the container will be effective to separate clothing items during a drying cycle, which encourages (i.e., opens up) air circulation and a faster drying time (which, in turn, limits the amount of energy required to dry the clothing items).

Although illustrative embodiments of the present invention have been described herein, it should be understood that the invention is not limited to those described, and that various other changes or modifications may be made by one skilled in the art without departing from the scope or spirit of the invention.

What is claimed is:

1. A laundry additive disposed in a device for delivering said laundry additive to a plurality of wash cycles and drying cycles, wherein said device comprises a container that comprises an inner chamber and a plurality of apertures and protrusions located on an exterior surface of the container, wherein (i) the apertures are configured to allow the laundry additive to leave the inner chamber and interact with clothing during a plurality of wash cycles and drying cycles; and (ii) the protrusions are configured to make contact with clothing during the drying cycles, and wherein said laundry additive is a spherical pearl consisting of sodium percarbonate, sodium bicarbonate, nano silver, tea tree oil, and coconut acid monoethanol (CMEA), and optionally a plurality of elongated elements selected from the group consisting of recycled paperboard, soy wax, fragrance, a plant based fabric softener, a vegetable based fabric softener and combinations thereof.

2. The laundry additive disposed in a device of claim 1, wherein the device comprises a cap that may be reversibly removed from and attached to the device.

3. The laundry additive disposed in a device of claim 1, wherein the apertures located on the exterior surface of the container are circular.

4. The laundry additive disposed in a device of claim 1, wherein the protrusions located on the exterior surface of the container exhibit a convex rounded configuration.

5. The laundry additive disposed in a device of claim 1, wherein the laundry additive is configured as a solid.

6. The laundry additive disposed in a device of claim 1, wherein the plurality of elongated elements are present.

7. The laundry additive disposed in a device of claim 1, wherein the container is comprised of thermoplastic elastomer.

8. The laundry additive disposed in a device of claim 1, wherein the container comprises an egg-shaped dimension, which exhibits a circumference that is greatest in a center area and gradually becomes smaller from the center area to each side of the container.

9. A method for delivering a laundry additive to at least one wash cycle and at least one drying cycle, which comprises (a) placing a laundry additive disposed in a delivery device according to claim 1 and a set of cloths in a wash cycle; and (b) following the wash cycle, transferring the cloths and said laundry additive disposed in a delivery device to a drying cycle.

10. The method of claim 9, wherein the container comprises a cap that may be removed from and attached to the container.

11. The method of claim 9, wherein the apertures located on the exterior surface of the container are circular.

12. The method of claim 9, wherein the protrusions located on the exterior surface of the container exhibit a convex rounded configuration.

13. The method of claim 9, wherein the laundry additive is configured as a solid.

14. The method of claim 9, wherein the plurality of elongated elements are present.

15. The method of claim 9, wherein the container is comprised of thermoplastic elastomer.

16. The method of claim 9, wherein the container comprises an egg-shaped dimension, which exhibits a circumference that is greatest in a center area and gradually becomes smaller from the center area to each side of the container.

* * * * *